US006603405B2

(12) United States Patent
Smith

(10) Patent No.: US 6,603,405 B2
(45) Date of Patent: Aug. 5, 2003

(54) VEHICLE-CENTRIC WEATHER PREDICTION SYSTEM AND METHOD

(75) Inventor: Michael Smith, Wichita, KS (US)

(73) Assignee: User-Centric Enterprises, Inc., Wichita, KS (US)

( * ) Notice: Subject to any disclaimer, the term of this patent is extended or adjusted under 35 U.S.C. 154(b) by 50 days.

(21) Appl. No.: 09/729,642

(22) Filed: Dec. 5, 2000

(65) Prior Publication Data

US 2002/0067289 A1 Jun. 6, 2002

(51) Int. Cl.[7] ..... G08G 1/09

(52) U.S. Cl. ..... 340/905; 340/995.1; 340/601; 340/602; 701/202; 701/209; 702/3

(58) Field of Search ..... 340/905, 990, 340/907, 995, 934, 933, 936, 968, 601, 602; 342/26; 701/50, 213, 202, 209, 117, 118; 455/414, 419; 702/3; 705/1

(56) References Cited

U.S. PATENT DOCUMENTS 5,508,930 A * 4/1996 Smith, Jr. ..... 364/444
5,699,056 A * 12/1997 Yoshida ..... 340/905
5,991,687 A 11/1999 Hale et al. ..... 701/207
6,009,374 A 12/1999 Urahashi ..... 701/209
6,018,699 A 1/2000 Baron, Sr. et al. ..... 702/3
6,031,455 A * 2/2000 Grube et al. ..... 340/539
6,112,074 A * 8/2000 Pinder ..... 455/404
6,125,328 A 9/2000 Baron et al.
6,154,699 A * 11/2000 Williams ..... 701/50
6,167,255 A * 12/2000 Kennedy, III et al. ..... 455/414
6,198,390 B1 * 3/2001 Schlager et al. ..... 340/540
6,240,365 B1 * 5/2001 Bunn ..... 701/213
6,255,953 B1 7/2001 Barber
6,289,331 B1 * 9/2001 Pedersen et al. ..... 706/60
6,295,001 B1 9/2001 Barber
6,304,816 B1 * 10/2001 Berstis ..... 701/117

* cited by examiner

*Primary Examiner*—Benjamin C. Lee
(74) *Attorney, Agent, or Firm*—Banner & Witcoff, Ltd.

(57) ABSTRACT

The invention provides a system and method for receiving weather forecast information in a vehicle and using that information to warn a vehicle operator of a future weather hazard with reference to the vehicle's intended direction of travel. A weather forecasting center maintains a database and display of forecast weather hazards across a large area. The forecasting center also receives information regarding the, location of each of a plurality of vehicles, such as automobiles or a fleet of commercial trucks. A hazard location algorithm compares a forecast location of each vehicle with a forecast weather hazard and transmits a warning to each vehicle that is predicted to encounter the hazard. The warning can take the form of text, audio, and/or a visual display indicating, for example, that the weather hazard will continue for a certain period of time. As the vehicle moves, its actual position is updated in the forecasting center, and a revised warning is transmitted to the vehicle.

43 Claims, 6 Drawing Sheets

| | | | | | | | |
|---|---|---|---|---|---|---|---|
| $W_0$ | $W_{10}$ | $W_{20}$ | $W_{30}$ | | | | |
| $W_0$ | $W_{10}$ | $W_{20}$ | $W_{30}$ | $V_{30}$ | $V_{20}$ | $V_{10}$ | $V_0$ |
| $W_0$ | $W_{10}$ | $W_{20}$ | $W_{30}$ | | | | |
| $W_0$ | $W_{10}$ | $W_{20}$ | $W_{30}$ | | | | |

FIG. 3A

| | | | | | | | |
|---|---|---|---|---|---|---|---|
| $W_0$ | $W_0$ | $W_{10}$ | $W_{20}$ | $W_{30}$ | | | |
| $W_0$ | $W_0$ | $W_{10}$ | $W_{20}$ | $W_{30}$ | | | |
| | | | $V_{30}$ | $V_{20}$ | $V_{10}$ | $V_0$ | |
| $W_0$ | $W_0$ | $W_{10}$ | $W_{20}$ | $W_{30}$ | | | |
| $W_0$ | $W_0$ | $W_{10}$ | $W_{20}$ | $W_{30}$ | | | |

FIG. 3B

| | | | | | | | |
|---|---|---|---|---|---|---|---|
| $W_0$ | $W_0$ | $W_0$ | $W_{10}$ | $W_{20}$ | $W_{30}$ | | |
| | $W_0$ | $W_0$ | $W_{10}$ | $W_{20}$ | $W_{30}$ | | |
| | | $V_{30}$ | $V_{20}$ | $V_{10}$ | $V_0$ | | |
| $W_0$ | $W_0$ | $W_0$ | $W_{10}$ | $W_{20}$ | $W_{30}$ | | |
| $W_0$ | $W_0$ | $W_0$ | $W_{10}$ | $W_{20}$ | | | |

FIG. 3C

| | | | | | | | |
|---|---|---|---|---|---|---|---|
| | | | | | | | |
| | $W_0$ | $W_0$ | $W_0$ | $W_{10}$ | $W_{20}$ | $W_{30}$ | |
| | | $W_0$ | $W_0$ | $W_{10}$ | $W_{20}$ | $W_{30}$ | |
| | $V_{30}$ | $V_{20}$ | $V_{10}$ | $V_0$ | | | |
| | $W_0$ | $W_0$ | $W_0$ | $W_{10}$ | $W_{20}$ | $W_{30}$ | |
| | $W_0$ | $W_0$ | $W_0$ | $W_{10}$ | $W_{20}$ | $W_{30}$ | |

FIG. 3D

| | | | | | | | |
|---|---|---|---|---|---|---|---|
| | | | | | | | |
| | | $W_0$ | $W_0$ | $W_0$ | $W_{10}$ | $W_{20}$ | $W_{30}$ |
| | | | $W_0$ | $W_0$ | $W_{10}$ | $W_{20}$ | $W_{30}$ |
| $V_{30}$ | $V_{20}$ | $V_{10}$ | $V_0$ | | | | |
| | | $W_0$ | $W_0$ | $W_0$ | $W_{10}$ | $W_{20}$ | $W_{30}$ |
| | | $W_0$ | $W_0$ | $W_0$ | $W_{10}$ | $W_{20}$ | $W_{30}$ |

FIG. 3E

| | | | | | | | |
|---|---|---|---|---|---|---|---|
| | | | | | | | |
| | | | $W_0$ | $W_0$ | $W_0$ | $W_{10}$ | $W_{20}$ |
| $V_{20}$ | $V_{10}$ | $V_0$ | | $W_0$ | $W_0$ | $W_{10}$ | $W_{20}$ |
| | | | $W_0$ | $W_0$ | $W_0$ | $W_{10}$ | $W_{20}$ |
| | | | $W_0$ | $W_0$ | $W_0$ | $W_{10}$ | $W_{20}$ |

FIG. 3F

| | | | | | | | |
|---|---|---|---|---|---|---|---|
| | | | | | | | |
| | | $W_0$ | $W_{10}$ | $W_{20}$ | | | |
| | | $W_0$ | $W_{10}$<br>$V_{30}$ | $W_{20}$<br>$V_{20}$ | | | |
| | | $W_0$ | $W_0$ | $W_0$ | $V_{10}$ | | |
| | | | | | | $V_0$ | |

FIG. 4A

| | | | | | | | |
|---|---|---|---|---|---|---|---|
| | | | | | | | |
| | | $W_0$ | $W_{10}$ | $W_{20}$ | | | |
| | | $W_0$<br>$V_{30}$ | $W_{10}$<br>$V_{20}$ | $W_{20}$<br>$V_{10}$ | | | |
| | | $W_0$ | $W_0$ | $W_0$ | $W_{10}$<br>$V_{10}$ | | |
| | | | | | | | |

FIG. 4B

| | | | | | | | |
|---|---|---|---|---|---|---|---|
| | | | | | | | |
| | | $W_0$ | $W_0$ | $W_{10}$ | $W_{20}$ | | |
| | | $W_0$ | $W_{10}$<br>$V_{10}$ | $W_{20}$<br>$V_0$ | $W_0$ | | |
| | | $V_{20}$ | | | | | |
| | $V_{30}$ | | | | | | |

FIG. 4C

VEHICLE-CENTRIC WEATHER PREDICTION SYSTEM AND METHOD

TECHNICAL FIELD

The present invention relates generally to weather forecasting and warning systems. More particularly, the invention provides a method and apparatus for receiving weather forecast information in a vehicle and using that information to warn a vehicle operator of a future weather hazard with respect to the specific vehicle's intended direction of travel.

BACKGROUND OF THE INVENTION

Vehicle operators, such as automobile drivers, frequently tune to radio stations while traveling in order to obtain weather forecast information. Such forecasts generally cover a large geographic area, such as an entire county or a multi-county region, and can provide some indication to the vehicle operator of likely weather trouble, such as a flash flood or tornado. Because they cover such large areas, however, generalized weather forecasts may cause wasteful evasive action by drivers not realistically at risk. For example, if the National Weather Service issues a flash flood warning for an entire county, all drivers in the county may need to heed the warning, even if the flood areas make up only a small part of the county.

Similarly, if a sudden snowstorm approaches from the west, a large number of drivers may take evasive action based on a general weather forecast for cities in the path of the approaching storm. Depending on where the drivers are relative to the weather hazard, some drivers may feel the effects of the storm shortly after the warning, while others may not be in the path of the storm for 10, 20, or even 30 minutes. Providing drivers with more accurate and vehicle-specific weather forecasts could result in substantial time and energy savings. For example, if a driver is heading West and is projected to arrive at his destination within 20 minutes, it would be helpful to know that the storm will not arrive at the intended destination for another 30 minutes. Such a system would be particularly useful for fleets of commercial trucks or buses, for example, particularly since such vehicles may be more susceptible to causing injury or property damage during severe weather events (e.g., snow, ice storms, and the like).

Various position-sensitive automated vehicle systems have been proposed. For example, U.S. Pat. No. 5,991,687 ("System and Method for Communicating Information Related to a Geographic Area") describes a system for displaying the location of a vehicle to the vehicle operator, along with other information such as a weather map. However, the system cannot provide the sort of information that would pen-nit a vehicle operator to determine whether he or she was likely to encounter a weather hazard and for how long such a hazard might last.

Another system, disclosed in U.S. Pat. No. 6,009,374 ("Apparatus for and Method of Controlling Vehicular Systems While Travelling"), assists a vehicle operator by automatically controlling the vehicle in response to various detected conditions and an intended travel position. One variation of the system extracts current weather information and uses the information to sound an alarm. The system, however, does not provide predicted weather information to the vehicle operator; it does not provide hazard duration information; and it does not provide weather information tailored to the particular vehicle. Consequently, the system does not solve the a aforementioned problems.

Yet another system, described in U.S. Pat. No. 6,018,699 ("Systems and Methods for Distributing Real-Time Site Specific Weather Information"), reports weather forecasts through the use of storm profiles that are transmitted to remote units at dispersed geographic sites. The remote units are stationary, and storm profiles are transmitted to remote units based on their geographic location. The system has no application for use with moving vehicles, as it cannot receive information concerning the mobile location of such vehicles.

The aforementioned problems give rise to the solutions provided by the present invention.

SUMMARY OF THE INVENTION

The invention provides a system and method for receiving weather forecast information in a vehicle and using that information to warn a vehicle operator of a future weather hazard with reference to the vehicle's intended direction of travel. In one embodiment, a weather forecasting center maintains a database and display of weather hazards (current and predicted) across a large area, such as the entire United States and adjacent coastal waters. The forecasting center also receives information regarding the location of each of a plurality of vehicles, such as automobiles or a fleet of commercial trucks.

A hazard location algorithm compares a forecast location of each vehicle with a forecast weather hazard and transmits a warning to each vehicle that is predicted to encounter the hazard. The warning can take the form of text, audio, and/or a visual display indicating, for example, that the vehicle will likely encounter heavy snow in approximately 30 minutes, and that the heavy snow will last for approximately 45 minutes. As the vehicle moves, its actual position is updated in the forecasting center, and a revised warning is transmitted to the vehicle. The warning can be conveyed to the vehicle in terms of mile posts, railroad stations, waypoints, Very High Frequency Omnidirectional Range Stations (VORs), etc.

In one variation, the location of the vehicle can be extracted from a data stream (e.g., an aircraft situation display data stream obtained from the FAA), instead of being transmitted from each vehicle. Vehicle operators can file a trip plan with the forecasting center, such that the predicted future location can be compared to an actual location. Information relating to pavement temperatures and other local measurements can be provided to the prediction center and used to help generate warnings to vehicle operators. Other features and advantages of the invention will become apparent by reading the following detailed description, figures, and claims.

BRIEF DESCRIPTION OF THE DRAWINGS

FIG. 3A shows a current weather grid including current and forecast weather hazards, and current and forecast vehicle locations.

FIG. 3B shows the weather grid of FIG. 3A after ten minutes have elapsed.

FIG. 3C shows the weather grid of FIG. 3A after twenty minutes have elapsed.

FIG. 3D shows the weather grid of FIG. 3A after thirty minutes have elapsed.

FIG. 3E shows the weather grid of FIG. 3A after forty minutes have elapsed.

FIG. 3F shows the weather grid of FIG. 3A after fifty minutes have elapsed.

FIG. 4A shows a current weather grid including current and forecast weather hazards, and current and forecast vehicle locations.

FIG. 4B shows the weather grid of FIG. 4A after ten minutes have elapsed.

FIG. 4C shows the weather grid of FIG. 4A after twenty minutes have elapsed.

DETAILED DESCRIPTION OF THE INVENTION

Figure 1:
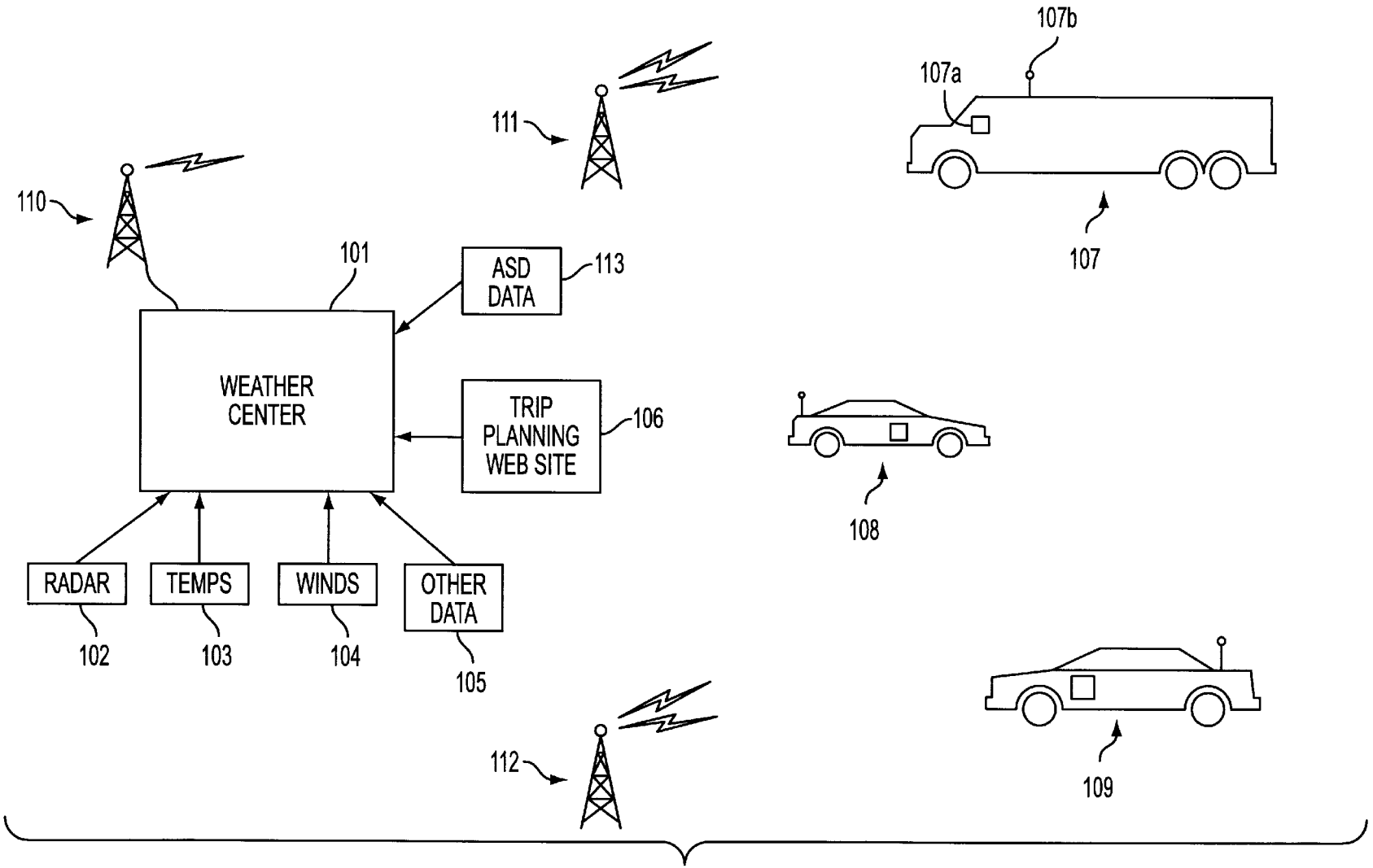
FIG. 1 shows a system including a weather center that provides weather hazard information to a plurality of vehicles 107, 108 and 109.

FIG. 1 shows a system employing various principles of the present invention. As shown in FIG. 1, a weather center 101 receives weather-related information from various sources, such as one or more radar sources 102, temperature data sources 103, wind data sources 104, and other data sources 105 (including, but not limited to, regional weather stations that provide air and pavement temperature, humidity, and other measurements). One or more antennas 110 are also coupled to weather center 101 to receive information regarding the location of vehicles that have pre-registered to use the system. In addition to or instead of radio frequency communication, this information can be received over the Internet or other computer network, or via dedicated dial-up telephone lines. Additionally, Aircraft Situation Display (ASD) data 113 can be received from various sources, such as the FAA, which distributes information regarding the current location and identity of aircraft.

In one embodiment, weather center 101 is coupled to one or more trip planning web sites 106, which allow vehicle operators to pre-register with the system and to optionally file trip plans, similar in nature to so-called "flight plans" that are filed by pilots. In this embodiment, described in more detail herein, vehicle operators provide information regarding the identity of the vehicle, the intended starting point and destination, and route information (e.g., which highways will be traversed), and this information is stored in weather center 101 for tracking purposes.

Each vehicle 107, 108 and 109 includes a corresponding device, illustrated by element 107*a*, that receives weather hazard information from weather center 101 pertaining to that vehicle's current and/or future predicted location. In certain embodiments, each vehicle is equipped with a navigational device such as a GPS receiver that enables the vehicle to determine its present position and a radio frequency transmitter that transmits the vehicle's current location to weather center 101. Additionally, as described below, each device preferably includes a display and/or audible device that permits weather hazard information to be communicated to the vehicle operator. In one embodiment, the vehicle operator receives information from a cellular telephone; a wireless Personal Digital Assistant (PDA); or other similar device.

It is presumed that a network of radio antennae illustrated as elements 110, 111, and 112 is available to relay signals to and from each vehicle. Alternatively, satellite communication can be used, or a combination of the two can be used. Various commercially available systems, such as the so-called "ON STAR™" system, can be used to transmit and receive information including vehicle identification and location information. For aircraft, the FAA provides a data stream that identifies each aircraft by its tail number and provides the current location of the aircraft. Although not critical to the invention, it is contemplated that each vehicle user (or fleet operator, where appropriate) will pre-register each vehicle with weather center 101 by providing vehicle identification information that can then be used to correlate vehicle locations with particular vehicles. Weather center 101 may charge a fee for weather hazard reporting services on a monthly or transaction basis, thus providing a commercially beneficial arrangement.

In general, weather center 101 generates weather hazard predictions for a plurality of geographic areas, such as four square kilometer "cells," and compares the location (current and predicted) of each cell in which there is a future weather hazard to vehicle locations. For each weather hazard, weather center 101 transmits a warning to each vehicle that is predicted to intersect with the cell, and optionally provides information concerning the nature of the hazard (e.g., severe snowstorm), the predicted time before the hazard will occur, based on the vehicle's current path (including, for example, the direction and speed of the vehicle), and the predicted duration of the hazard.

Weather center 101 monitors weather conditions around various geographic areas such as counties, States, bodies of water, or the entire United States, and forecasts future weather hazards such as severe storms, hail, snow, wind, ice, tornados, or other types of hazards. There are numerous methods of predicting weather involving both computers and humans, and various companies provide weather forecasting services, as does the National Weather Service. One example of a weather predicting method is disclosed in U.S. Pat. No. 5,959,567, entitled "Method and Apparatus for Tracking of Organized Storms."

Figure 2:
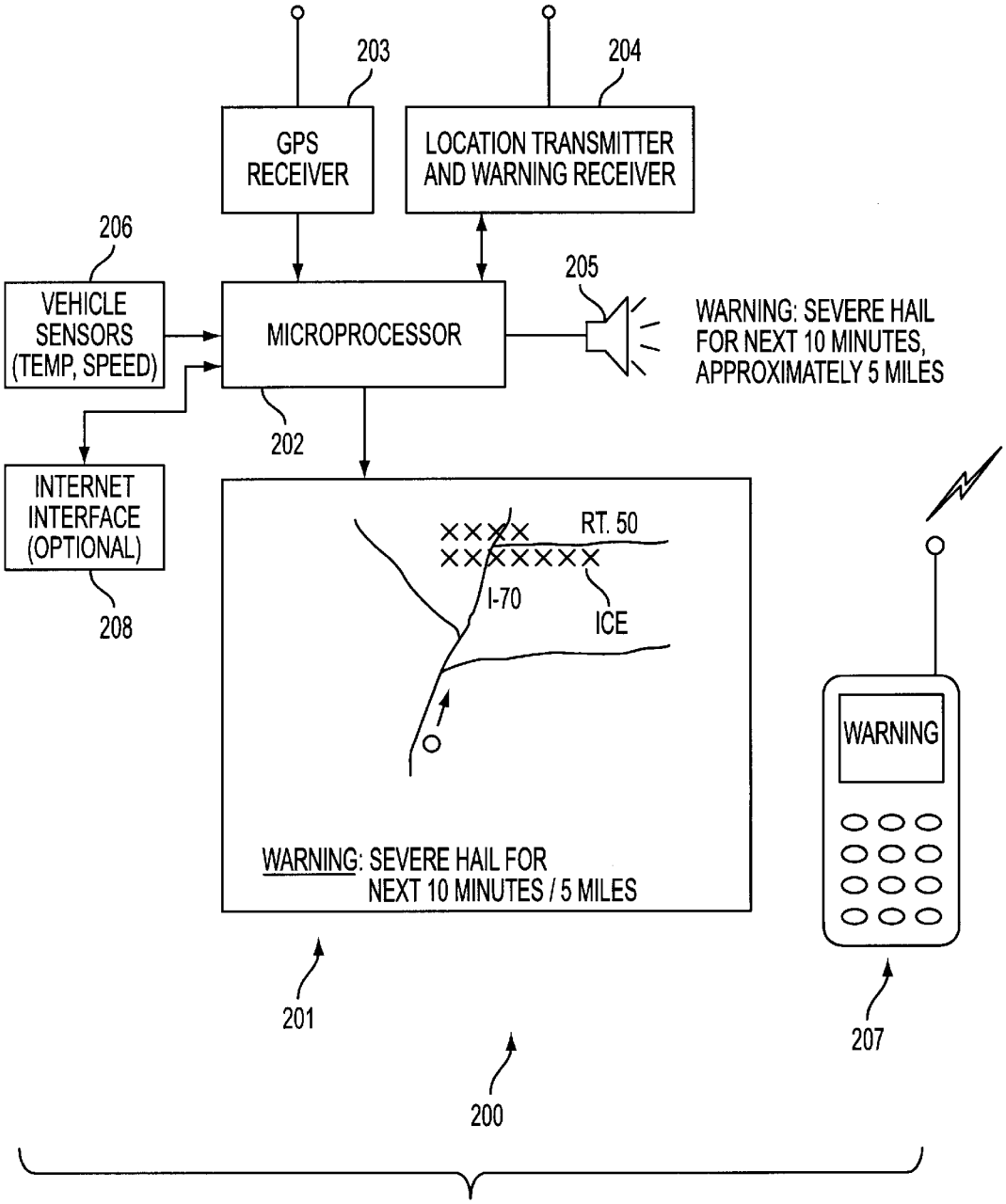
FIG. 2 shows one possible configuration for a vehicle warning system and method including a display 201 that shows weather hazard information and a cell phone 207 that optionally displays weather hazard information.

FIG. 2 shows one possible embodiment for a device that can be installed in vehicles in accordance with the principles of the present invention. It will be appreciated that various types of vehicle navigational aids are commercially available, including GPS receivers and map displays that identify a vehicle operator's current location. The inventive principles can be applied by modifying any of these commercially available units to incorporate additional functions contained herein. Moreover, various commercially available systems can be installed in a vehicle to transmit the current location of the vehicle for various purposes, such as theft prevention and vehicle recovery.

As shown in FIG. 2, a GPS receiver 203 receives information from satellites that permits the vehicle to determine its current location with a reasonable degree of accuracy. This information is fed into a microprocessor 202, which is programmed to periodically transmit the information through a location transmitter 204, or through an Internet interface 208 using wireless means (including, for example, a cellular telephone). Additional information from the vehicle, such as data from vehicle sensors (e.g., temperature, speed, etc.) can be transmitted to the weather center through transmitter 204 or 208.

Microprocessor 202 can be programmed with information regarding where to transmit the vehicle information (e.g., a radio frequency, Internet Protocol address, or the like). Instead of a single weather center, multiple weather centers can of course be provided, and each vehicle can transmit to the nearest weather center based on its location.

Alternatively, distributed receiving centers can forward vehicle location information to a central weather center using a computer network such as the Internet. Location transmitter 204 in certain embodiments includes a receiver that receives warnings transmitted from the weather center. Alternatively, the warnings can be received through Internet interface 208, or can even be received at a cellular telephone 207 associated with the vehicle operator. In the latter embodiment, warnings can be transmitted as text and/or audio messages to a cellular telephone number provided by the vehicle operator.

In one embodiment, a vehicle map display 201 of the type commonly used in commercially available vehicle navigation systems is coupled to the microprocessor 202. As shown, the map shows the current location of the vehicle superimposed on a map, such as a street or county map. Additionally, warning information received from the weather center can be superimposed in the form of text and/or graphics on the map display in order to indicate the proximity and direction of the weather hazard to the vehicle operator. A speaker 205 can be used to generate audio warnings.

Turning to the operation of the weather center, in one embodiment a computerized database of current and forecast weather information is generated and periodically updated. This data can be stored in a grid-type data structure in which a geographic area is divided into cells of a given size (e.g., four nautical miles on each side). In other words, weather hazard information extracted from a weather map (extracted either by human means or by computer) is converted into a discrete hazard indicator (e.g., severe snow, severe thunderstorm, hail, etc.) and the indicator is stored into a cell corresponding to the area over which the hazard will occur. A county, for example, may be divided into a plurality of fixed-size cells, and a storm moving through the county may cause hazard indicators to be stored in a subset of those cells as the storm moves.

For purposes of illustration, it will be assumed that a geographic region is divided into a plurality of cells. In each cell for which a current or forecast hazard exists, a hazard indicator is stored to indicate the current or predicted weather condition in the cell. The grid is updated as the weather situation changes. Thus, every few minutes, the grid is updated to reflect the latest current and predicted future weather information.

In one embodiment, information concerning each vehicle location is also maintained in the weather grid, such that overlaps between forecast weather hazards and forecast vehicle locations can be identified by computer. Assume that a severe thunderstorm is moving directly from west to east, and a vehicle is driving directly toward the advancing storm (i.e., from east to west). FIG. 3A shows a current weather grid including a plurality of cells in which a current weather hazard $W_0$ exists in five cells on the left side of the grid. A forecast weather hazard $W_{10}$ (i.e., predicted to hit in 10 minutes) exists in the next set of cells just to the east of the current weather hazard. Similarly, a forecast weather hazard $W_{20}$ exists just to the east of the 10-minute forecast, and a forecast weather hazard $W_{30}$exists just to the east of the 20-minute prediction. Thus, assuming that each cell measures 4 nautical miles on each side, FIG. 3A shows that the storm is generally moving east at a rate of 4 nautical miles every 10 minutes. Although only one weather hazard per cell is shown, it is of course possible to have multiple weather hazards activated in each cell (e.g., severe hail and severe lightning, for example). It will be appreciated that different cell sizes and granularity can be used as desired; in general, smaller cell sizes will result in increased computational needs.

Also shown in FIG. 3A is a forecast vehicle location, illustrated by the notation $V_0$ (vehicle position now) through $V_{30}$(forecast vehicle location 30 minutes from the present time). As shown in FIG. 3A, the vehicle is moving due west at approximately 4 nautical miles every 10 minutes. At the initial time as shown in FIG. 3A, the current vehicle position is not in a cell for which a weather hazard exists, and there is no projected overlap for the next 30 minutes based on the 30-minute forecast weather hazard (indicated by $W_{30}$) and the 30-minute forecast vehicle position (indicated by $V_{30}$).

FIG. 3B shows the weather grid of FIG. 3A after ten minutes has elapsed. In FIG. 3B, all of the current and forecast weather hazards have moved one cell to the right (i.e., moved due east by four nautical miles), and the vehicle positions (current and forecast) have moved to the left by one cell (i.e., moved due west by four nautical miles). Consequently, there is now an overlap between the vehicle's 20-minute forecast location and the storm's forecast 30-minute future location. According to one variation of the invention, the weather center generates a warning to the vehicle indicating that a weather hazard is forecast to hit the vehicle in 30 minutes and, optionally, when the vehicle will "clear" the hazard. In general, the system looks for matches to indicate the time that the hazard will first be encountered and its duration (i.e., based on the number of cells that the vehicle is expected to travel through). There may be times when the hazard is so large that the end of the hazard will be beyond the 30-minute interval; in such cases, no "duration" need be provided.

There are many different ways of evaluating the overlap situations illustrated in FIGS. 3A through 3F, and the following is intended to provide one example only. In one variation, for each overlapping cell, if the vehicle forecast time is greater than the weather forecast time (e.g., $V_{30}$is greater than $W_{20}$), the cell is ignored for warning purposes, whereas if the weather forecast time is greater than or equal to the vehicle forecast time, a warning is generated. Thus, according to one variation of the method, a warning is generated for only one cell in FIG. 3B (i.e., the cell containing $W_{30}$and $V_{20}$). The warning time is the weather forecast time for that cell (i.e., 30 minutes). The validity of this prediction can be seen by looking forward to FIG. 3E, which shows the situation 30 minutes later (i.e., the current vehicle position $V_0$coincides with a current weather hazard, $W_0$).

Turning now to FIG. 3C (twenty minutes later), there are four cells in which the vehicle's location falls in cells containing weather hazards. However, the two leftmost cells contain overlaps where the vehicle forecast time is greater than the weather forecast time, and these can be ignored. The remaining two cells indicate that the vehicle's current location is in a 30-minute hazard cell (cell containing $V_0$), and that the vehicle's 10-minute future location is in a 20-minute hazard cell (cell with $V_{10}$). The hazard time can be calculated as $T=V+(W-V)=W$, or 20 minutes. That is, the hazard time is the weather forecast time in the leftmost cell that does not contain a vehicle forecast time that exceeds a weather forecast time. The validity of this forecast can be seen by looking forward to FIG. 3E (twenty minutes hence), which shows that the vehicle is in a cell experiencing a weather hazard.

Alternatively, where multiple overlapping cells occur, a subtraction value $W-V$ can be obtained (i.e., subtract the vehicle forecast time from the weather forecast time) for each cell. The cell containing the lowest non-negative number is used to generate the warning value, and the warning value is the weather forecast time. For example, in FIG. 3B, there are two overlapping cells, the first one having a W−V value of −10, and the second having a W−V value of +10. The cell containing the +10 value is used, and its weather forecast time is 30 minutes. Therefore, a 30-minute hazard warning is generated. Similarly, in FIG. 3C, there are four overlapping cells, as follows: first cell W−V=−30; second cell W−V=−10; third cell W−V=+10; fourth cell W−V=+30. The cell generating the lowest non-negative number has a weather forecast value of 20 minutes, which can be verified by looking ahead 20 minutes (FIG. 3E). Similarly, in FIG. 3D, there are three overlapping cells, as follows: first cell W−V=−20; second cell W−V=−10; third cell W=V=+10. The weather forecast value of that cell is 10 minutes, which can be verified by looking ahead 10 minutes (to FIG. 3E). Finally, in FIG. 3E there is only one overlapping cell, which has a W−V value of zero. The weather forecast value for that cell is zero, indicating that a weather hazard presently exists for the vehicle.

FIGS. 4A to 4C show a different scenario in which the vehicle's predicted path changes over time (i.e., from generally northwest to generally southwest). Beginning in FIG. 4A, at an initial time there is an overlap between two cells. The first cell has a W−V value of −20, and the second cell has a W−V value of zero. The weather forecast for the non-zero cell is 20 minutes, indicating that a weather hazard will occur in 20 minutes.

In FIG. 4B, ten minutes later, there are four overlapping cells, with W−V values as follows: first cell, W−V=−30; second cell, W−V=−10; third cell, W−V=+10; fourth cell, W−V=0. The two non-negative cells show weather hazard forecast times of 20 minutes and 10 minutes, respectively. The lowest non-negative cell has a forecast time of 10 minutes, which can be given as the warning.

In FIG. 4C (twenty minutes after FIG. 4A), the forecast vehicle position has now shifted to a southwest position, possibly as a result of receiving updated position information from the vehicle, or due to an interpolated new path based on updated information, or due to other information such as deviation from a previously provided travel plan. In FIG. 4C, there are two overlapping cells, with W−V values as follows: first cell, W−V=0; second cell, W−V=+10. Using the cell having the lowest value (0), the forecast weather hazard time is 10 minutes, which can be given as the warning.

In addition to providing a warning indicating the time that a weather hazard will be encountered, the system can provide an estimate as to the duration of the hazard, based on the current travel path of the vehicle. For example, if the weather grid indicates that the forecast vehicle position for the next 30 minutes will intersect cells in which storm activity is predicted for the next 30 minutes, but thereafter will be cleared of the storm cells, the system can inform the vehicle operator that the weather hazard will last for 30 minutes. In FIG. 3C, for example, a hazard duration value of 20 minutes can be given, because the vehicle's 20 −minute future position is not in a cell that contains a weather hazard.

As explained above, weather center 101 preferably maintains information regarding the positional location (e.g., latitude and longitude) of each of a plurality of vehicles that have pre-registered with the weather center to provide mobile weather hazard reporting services. In one variation of the invention, each vehicle periodically transmits its current location to the weather center, and this information is used to update the weather grid. Vehicles can pre-register with weather center by providing identification information (e.g., the VIN for an automobile, a license plate number, fleet serial number, or the like), and this information is transmitted along with the positional information to weather center 101. Additionally, the computer in weather center 101 can extrapolate future (forecast) positions for the vehicle by comparing two previous locations along with the time differences between transmissions from those locations.

For example, if a vehicle has moved between two latitude/longitude points within a certain period of time, the computer can calculate a predicted heading and velocity based on these two points and the elapsed time between the points. This heading and velocity can be translated into cells using simple linear algebra.

Vehicle locations can also be correlated and interpolated based on a "flight plan" provided by a vehicle owner before leaving for a trip. A web site can be used to facilitate the entry and transmission of this information to weather center 101. For example, a driver can indicate on a map the starting point, ending point, and intended travel path (e.g., by highlighting this route on a graphical map). Weather center 101 can use this information to determine the likely position of a vehicle based on the starting time of the trip and the elapsed time. Additionally, information regarding speed limits on various highways can be taken into consideration when determining the likely position of a vehicle (e.g., if traveling on an interstate that has a 65-mph speed limit, the computer can assume that the vehicle has maintained this speed between two points). Consequently, weather center 101 does not or cannot receive a signal indicating vehicle position, it can estimate the position based on the trip plan filed by the vehicle operator. In the event that weather hazards are predicted for the vehicle, the system can suggest an alternate route that avoids or minimizes intersections with cells that have weather hazards.

In another variation of the invention, vehicles can register to use the service by using a telephone (e.g., a cell phone) to dial a telephone number and provide the cell phone number, to be activated for weather alerts. For example, a family traveling by automobile can use a cell phone to call a toll-free telephone number and enter the telephone number of the cell phone. Thereafter, they can periodically transmit their current location (either automatically through an apparatus of the type shown in FIG. 2) or through the cell phone itself. Weather center 101 can thereafter transmit weather hazard warnings directly to the cell phone, in the form of short text messages, or by voice messages.

Aircraft positions can be obtained from an Aircraft Situation Display (ASD) data source, such as that provided by the Federal Aviation Administration. In this variation of the invention, weather center 101 obtains periodic location information and identification information (e.g., tail numbers) and uses it to identify the location of airplanes. Consequently, it is not necessary for aircraft to transmit their location to weather center 101, although such a configuration is of course within the scope of the invention.

In addition to transmitting current location information, each vehicle may transmit other data, such as temperature and current and average velocity. Temperature data from the vehicle could be used, for example, to help predict whether the roads will be icy based on meteorological conditions.

Figure 5:
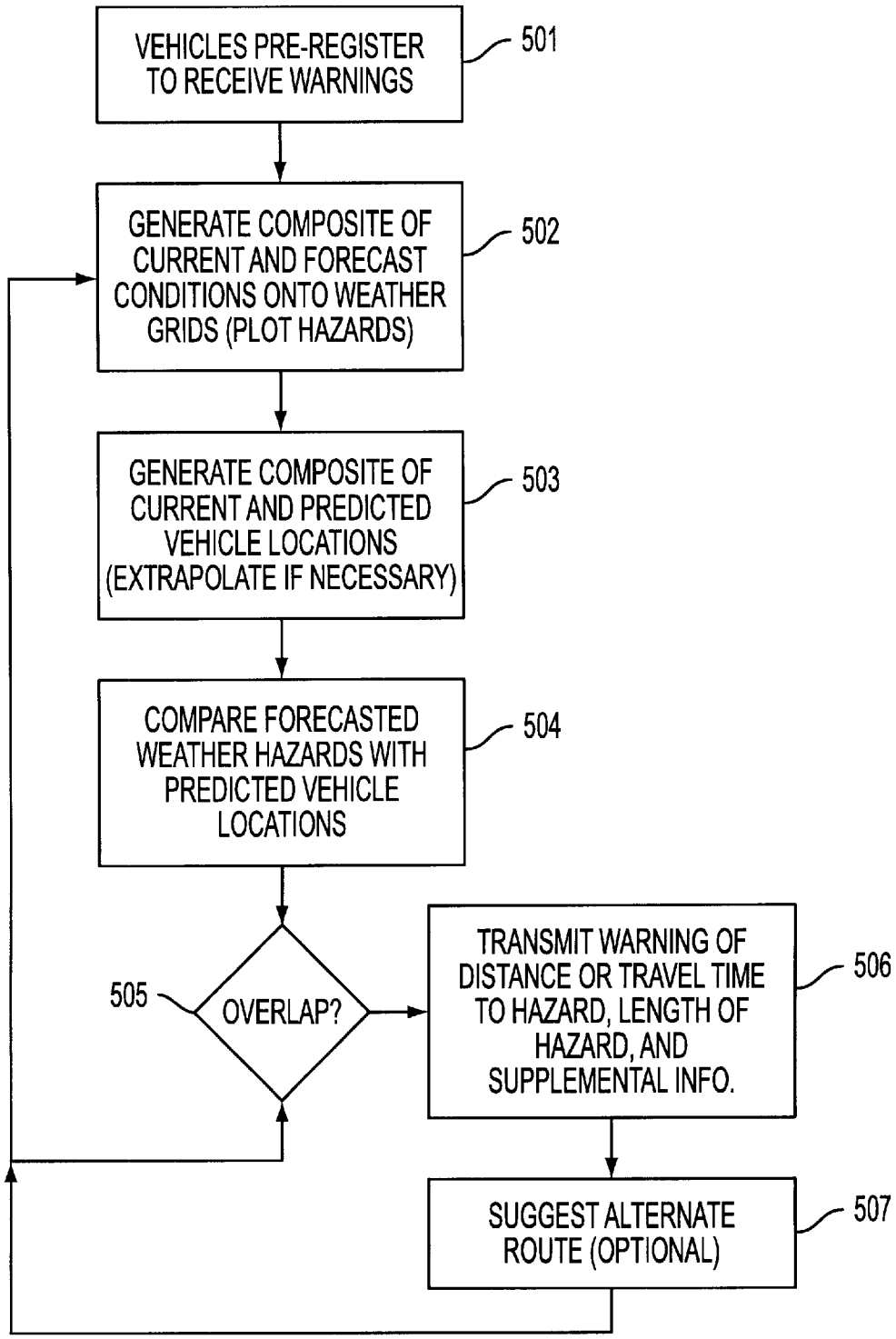
FIG. 5 shows a method of generating weather hazard information for vehicles according to various principles of the present invention.

FIG. 5 shows various steps of a method that can be used to carry out various principles of the present invention. Beginning in step 501, one or more vehicles pre-register to receive warnings. As described above, this pre-registration can occur by using a web site; a telephone; or by other means. The registration step associates a vehicle identifier with the vehicle, so that subsequent location updates for that vehicle identifier can be correlated with the vehicle, including means for communicating with the vehicle (e.g., an Internet Protocol address of a device in the car; a cell phone telephone number to which warnings will be transmitted, the network address of a wireless PDA; or the like). Once registered and activated, weather center 101 will track and provide warnings to the vehicle.

In step 502, a composite of current and forecast conditions is generated and mapped onto a weather grid such as the type shown in FIG. 3A. There are many different methods of predicting weather hazards, including human-originated means, computer-generated means, and combinations of the two. As is conventional, various meteorological displays can be generated to show various forms of precipitation, temperatures, pressures, and wind conditions. The data can include radar reflectivity data such as that generated by NEXRAD radars operated by the National Weather Service; "slime track" information showing the position of observed or actual tornados over a period of time; meteorologist-entered information such as the suspected location of a tornado or other severe weather event; information derived from spotters; and other data tending to show a severe weather event such as a tornado. In one embodiment, this information can also include predicted future storm or tornado tracks that are predicted using any of various technologies, such as those illustrated in U.S. Pat. No. 5,959,567, entitled "Method and Apparatus for Tracking of Organized Storms."

The future path of a storm or other severe weather event can be predicted in various ways. As noted above, a future storm path can be predicted using an algorithm of the type described in the '567 patent. In another embodiment, a future path can be predicted using human judgment (e.g., trained meteorologists monitoring various radar data and other sensed information). In yet another embodiment, a projected path as provided by the National Weather Service (NWS) can be used. The NWS often provides an array of points or "dots" that can be connected to determine the path along which a tornado or hurricane is expected to move.

A tornado location can be heuristically determined using a combination of radar echo shape ("hook" echo), radar wind velocity and echo structure, all well known in the meteorological community. Once the initial position is determined, a predicted future location can be predicted using the principles set forth in the '567 patent, or a meteorologist can use his or her judgment to establish a projected future path. The National Weather Service transmits a Tornado Detection Algorithm (TDA) in its WSR-88 radar data stream, and this TDA position could thus also be used. The NWS also uses its own movement algorithms, which could be employed in conjunction with the principles of the invention. Finally, information supplied by "spotters" can be used in conjunction with any of the above techniques in order to pinpoint the location of an actual tornado.

In step 503, a composite of current and forecast vehicle locations is generated and stored in a data structure like that of FIG. 3A, such that vehicle positions and weather hazards can be evaluated to determine whether there are intersections in cells that would warrant one or more warnings. As explained above, vehicle locations can be extrapolated if necessary, and updated as vehicle location updates are received.

In step 504, the forecast weather hazards and the forecast vehicle locations are compared to determine whether there are any overlaps. As explained above, for example, if a forecast vehicle position in 30 minutes will intersect with a cell in which a storm hazard is forecast for 30 minutes, a warning will be sent to the vehicle operator, based on the pre-registered information (e.g., information correlating the vehicle identifier to a cell phone number, IP address, or other communication tool). Additionally, the duration of the weather hazard can be provided based on the forecast path of the vehicle and the end of the weather hazard. For example, if a severe hailstorm is predicted to occur across a large number of cells, but the vehicle will have passed beyond the cells in 45 minutes, then the weather center can indicate that the hazard will subside in 45 minutes.

Consequently, in step 505 a warning of the distance or travel time to a hazard is transmitted to the vehicle or vehicles in the cell corresponding to the hazard, along with the duration of the hazard and other supplemental information as available (e.g., tornado spotted in the cell in which the vehicle is traveling). In step 506, an optional step of suggesting an alternate route can be provided.

What has been described above is merely illustrative of the application of the principles of the present invention. Other arrangements and methods can be implemented by those skilled in the art without departing from the spirit and scope of the present invention. Any of the methods of the invention can be implemented in software that can be stored on computer disks or other computer-readable media for execution in a computer. The invention can be implemented using web browser technology, handheld computing units, and/or cellular telephones. Moreover, the invention has wide application for various types of weather hazards including lightning, hail, hurricanes, wind shear, and the like, and the inventive principles can be applied equivalently to such phenomena. No claim should be interpreted to be in means plus function format. Numbered steps in method claims should not be interpreted to require a particular ordering of the steps.

What is claimed is:

1. A method of providing weather hazard information to a plurality of vehicles, comprising the steps of:

(1) generating a weather forecast covering a plurality of geographically specific cells, and indicating for each cell whether a forecast weather hazard exists for that cell;

(2) generating a plurality of forecast vehicle locations with respect to the plurality of geographically specific cells; and (3) generating a warning for each vehicle that is forecast to be in a cell for which a weather hazard forecast exists.

2. The method of claim 1, further comprising the step of transmitting the warning to each vehicle through wireless means.

3. The method of claim 2, further comprising the step of, prior to step (1), registering each of the plurality of vehicles in a database, and using the registration information to determine how to transmit the warning to each vehicle.

4. The method of claim 1, further comprising the step of transmitting the warning to a cellular telephone associated with the each vehicle.

5. The method of claim 4, further comprising the step of generating an audible warning in the each vehicle.

6. The method of claim 4, further comprising the step of generating a visual display in the each vehicle corresponding to the warning.

7. The method of claim 1, further comprising the step of, for each warning generated, further indicating a predicted duration of the weather hazard.

8. The method of claim 1, further comprising the step of receiving location information from each of the plurality of vehicles and using the received location information to generate the plurality of forecast vehicle locations.

9. The method of claim 8, wherein step (2) comprises the step of extrapolating future vehicle positions based on previously received location information from each of the plurality of vehicles.

10. The method of claim 1, wherein step (2) comprises the step of receiving location information from a data stream comprising a plurality of airplane identifiers and associated location information.

11. The method of claim 1, further comprising the step of receiving from one or more of the plurality of vehicles additional weather information, and using the additional weather information to aid in step (1).

12. The method of claim 1, further comprising the step of pre-registering a trip plan for one or more of the plurality of vehicles, and using the pre-registered trip plan in step (2).

13. The method of claim 1, wherein step (1) comprises the step of indicating for each cell a predicted hazard time value corresponding to the time at which the weather hazard is forecast to occur.

14. The method of claim 13, wherein step (2) comprises the step of indicating for each cell a predicted location time value corresponding to the time at which a vehicle is forecast to reside in that cell.

15. The method of claim 14, further comprising the step of subtracting the predicted hazard time for a given cell from the predicted location time for the cell to determine whether a warning should be generated for a particular cell.

16. A vehicle weather warning system, comprising:

a locator device that receives information sufficient to determine the location of the vehicle, and that outputs location information;

a transmitter that transmits the location information and vehicle identification information to a weather center;

a receiver adapted to receive a weather hazard warning signal, wherein the weather hazard warning signal is based at least in part on a weather forecast and based at least in part on a forecast location of the vehicle;

a warning device that generates warnings in response to a signal indicating the nature and duration of a weather hazard; and a microprocessor that controls the operation of the locator device, the transmitter, the receiver, and the warning device.

17. The vehicle weather warning system of claim 16, wherein the warning device comprises a display unit that displays map information with weather hazards superimposed thereon.

18. The vehicle weather warning system of claim 16, wherein the warning device comprises a speaker that produces an audible warning.

19. The vehicle weather warning system of claim 16, wherein the transmitter comprises a wireless Internet connection.

20. The vehicle weather warning system of claim 16, wherein the receiver comprises a wireless Internet connection.

21. The vehicle weather warning system of claim 16, further comprising a sensor that produces a meteorological data value that is transmitted through the transmitter to the weather center.

22. A data processing device for initiating weather warnings, comprising:

a processor;

memory storing computer readable instructions that, when executed, cause the data processing device to perform the steps of:

(i) based on received meteorological information, generating a weather forecast covering a plurality of geographically specific cells;

(ii) indicating for each cell whether a forecast weather hazard exists for that cell;

(iii) determining a future location for each of a plurality of mobile warning devices with respect to the plurality of geographically specific cells; and (iv) sending warning information corresponding to each vehicle that is forecast to be in a cell for which a weather hazard forecast exists.

23. A vehicle weather warning system, comprising:

a locator device that receives information sufficient to determine the location of the vehicle, and that outputs location information;

a transmitter that transmits the location information and vehicle identification information;

a receiver adapted to receive a weather hazard warning signal, wherein the weather hazard warning signal is based at least in part on a forecast location of the vehicle and a weather forecast, and wherein the signal indicates the location, nature and duration of a weather hazard;

a display unit that displays at least the vehicle's location in relation to the weather hazard responsive to the signal;

a speaker that produces an audible warning responsive to the signal; and a microprocessor that controls the operation of the locator device, the transmitter, the receiver, the display unit, and the speaker.

24. A weather warning system, comprising:

a locator device that receives information sufficient to determine the location of the system, and that outputs location information;

a transmitter that transmits the location information and identification information;

a receiver adapted to receive a weather hazard warning signal, wherein the weather hazard warning signal is based at least in part on a forecast location of the system and a weather forecast, and wherein the signal indicates the predicted location and nature of a weather hazard;

a display unit that displays at least the system's location in relation to the weather hazard responsive to the signal; and a microprocessor that controls the operation of the locator device, the transmitter, the receiver, and the display unit.

25. The system of claim 24, wherein the system comprises a personal digital assistant (PDA).

26. The system of claim 24, wherein the system comprises a mobile telephone.

27. The system of claim 24, further comprising a speaker that produces an audible warning responsive to the signal.

28. The weather warning system of claim 24, wherein the signal further indicates a duration of the weather hazard.

29. A weather warning device, comprising:

memory storing computer executable instructions that, when executed by a processor cause the device to perform a method, comprising:

(i) receiving forecast weather hazard information for a plurality of geographically distinct cells;

(ii) determining a future location of the weather warning device with respect to the geographically distinct cells; and (iii) causing an output device to output a warning when the future location of the weather warning device falls within one of the geographically distinct cells at a time when a forecast weather hazard exists for the one geographically distinct cell.

30. The device of claim 29, wherein the device comprises a personal digital assistant (PDA).

31. The device of claim 29, wherein the output device comprises a speaker that produces an audible warning.

32. The device of claim 29, wherein the output device comprises a display unit that displays a current location of the warning device in relation to current weather information.

33. The device of claim 29, wherein step (ii) comprises determining the future location based on a speed and a direction of travel of the weather warning device.

34. A data processing device for initiating weather warnings, comprising:

memory storing computer readable instructions that, when executed by a processor, cause the data processing device to perform the steps of:

(i) based on received meteorological information, generating a weather forecast covering a plurality of geographically specific cells;

(ii) indicating for each cell whether a forecast weather hazard exists for that cell;

(iii) determining a future location for a user with respect to the plurality of geographically specific cells; and (iv) initiating a weather warning corresponding to the user when the user is forecast to be in a cell for which a weather hazard forecast exists.

35. A method of providing a weather hazard warning, comprising:

(i) generating a weather forecast covering a plurality of geographically specific cells, and indicating for each cell whether a forecast weather hazard exists for that cell;

(ii) generating a forecast location of a user with respect to the plurality of geographically specific cells; and (iii) initiating a warning for the user when the user is forecast to be in a cell for which a forecast weather hazard exists.

36. A mobile system, comprising:

a display unit that displays a location of the mobile system on a map superimposed with forecast weather information based on a location of the mobile system; and a processor for controlling operation of the mobile system based on computer executable instructions for performing a method comprising outputting an alert when a forecast location of the system is predicted to encounter the forecast weather information.

37. The mobile system of claim 36, wherein the superimposed location of the mobile system represents a current location of the mobile system.

38. The mobile system of claim 36, wherein the superimposed location of the mobile system represents a future location of the mobile system.

39. The mobile system of claim 36, wherein the forecast weather information is based on radar data.

40. A method of providing a weather hazard warning, comprising:

(i) generating a forecast weather hazard for a predefined geographic area based on weather forecast information;

(ii) determining a future location of a user with respect to the predefined geographic area and (iii) initiating a warning for the user when the user is forecast to be in the predefined geographic area when the forecast weather hazard exists.

41. The method of claim 40, wherein the predefined geographic area comprises one or more of a plurality of geographically distinct cells.

42. The method of claim 40, wherein step (ii) comprises determining the future location based on a speed and a direction of travel of the user.

43. The method of claim 40, wherein in step (ii) the future location comprises a latitude and longitude.

* * * * *